US011511976B2

(12) United States Patent
Caldwell et al.

(10) Patent No.: US 11,511,976 B2
(45) Date of Patent: Nov. 29, 2022

(54) SYSTEM AND METHOD FOR DETERMINING A LIFTING CAPACITY OF A MACHINE

(71) Applicant: Caterpillar Inc., Peoria, IL (US)

(72) Inventors: Curtis John Caldwell, Metamora, IL (US); Sean D. Lawson, East Peoria, IL (US); Robert Jackson, Edwards, IL (US); Shikha Pokharel Thapa, Dunlap, IL (US); Aaron Gnagey, Morton, IL (US)

(73) Assignee: Caterpillar Inc., Peoria, IL (US)

( * ) Notice: Subject to any disclaimer, the term of this patent is extended or adjusted under 35 U.S.C. 154(b) by 649 days.

(21) Appl. No.: 16/594,433

(22) Filed: Oct. 7, 2019

(65) Prior Publication Data

US 2021/0101788 A1 Apr. 8, 2021

(51) Int. Cl.

| | |
|---|---|
| ***B66C 23/00*** | (2006.01) |
| ***B66C 23/72*** | (2006.01) |
| ***B66C 13/18*** | (2006.01) |
| ***B66C 23/90*** | (2006.01) |
| ***B66C 13/16*** | (2006.01) |

(52) U.S. Cl.

CPC ..... *B66C 23/72* (2013.01); *B66C 13/16* (2013.01); *B66C 13/18* (2013.01); *B66C 23/905* (2013.01); *B66C 2700/08* (2013.01)

(58) Field of Classification Search

CPC ..... B66C 23/72; B66C 23/90; B66C 23/905; B66C 23/94; B66C 13/16; B66C 13/18; B66C 13/44; B66C 13/46; B66C 2700/084

See application file for complete search history.

(56) References Cited

U.S. PATENT DOCUMENTS

| | | | | |
|---|---|---|---|---|
| 5,160,055 | A * | 11/1992 | Gray | B66C 23/90 212/278 |
| 5,598,935 | A | 2/1997 | Harrison et al. | |
| 8,807,910 | B1 | 8/2014 | Roden et al. | |
| 9,938,692 | B2 * | 4/2018 | Shatters | E02F 9/264 |
| 10,173,868 | B2 | 1/2019 | Nysse et al. | |

(Continued)

FOREIGN PATENT DOCUMENTS

| | | |
|---|---|---|
| CA | 2974819 | 1/2019 |
| CN | 103754777 | 6/2017 |

(Continued)

*Primary Examiner* — Emmanuel M Marcelo

(57) ABSTRACT

A system for determining a lifting capacity of a pipelayer is provided. The system includes a load sensor configured to generate a signal indicative of a load suspended from a lifting hook, an angle sensor configured to generate a signal indicative of an angular position of a chassis relative to ground surface, a boom position sensor configured to generate a signal indicative of a position of a boom relative to an undercarriage, and a counterweight position sensor configured to generate a signal indicative of a position of a counterweight relative to the undercarriage. The system further includes a controller configured to receive the signal from each of the load sensor, the angle sensor, the boom position sensor, and the counterweight position sensor. The controller is also configured to determine the lifting capacity of the pipelayer based, at least in part, on the received signal.

20 Claims, 5 Drawing Sheets

(56) References Cited

U.S. PATENT DOCUMENTS

| | | | | |
|---|---|---|---|---|
| 2004/0200644 | A1* | 10/2004 | Paine | G01G 19/083 177/136 |
| 2013/0020273 | A1 | 1/2013 | Chen et al. | |
| 2016/0169413 | A1 | 6/2016 | Camacho et al. | |
| 2021/0179395 | A1* | 6/2021 | Cohen | B66C 13/46 |

FOREIGN PATENT DOCUMENTS

| | | | |
|---|---|---|---|
| JP | 2018016442 | | 2/2018 |
| RU | 133822 | | 10/2013 |
| RU | 2727638 | C1 * | 7/2020 |

* cited by examiner

SYSTEM AND METHOD FOR DETERMINING A LIFTING CAPACITY OF A MACHINE

TECHNICAL FIELD

The present disclosure relates to a system and a method for determining a lifting capacity of a machine. More particularly, the present disclosure relates to the system and the method for determining the lifting capacity of the machine, such as a pipelayer.

BACKGROUND

A machine, such as a pipelayer, includes a boom assembly for lifting and lowering loads during a lift operation, such as a pipelaying operation. The machine may also include a counterweight system to provide a variable load lifting capacity of the machine and to stabilize the machine during the lift operation. During the lift operation, an operator of the machine may position the counterweight system in any of a retracted position, an extended position, or any intermediate position between the retracted position and the extended position. In most situations, in the retracted position of the counterweight system the machine may have a lowest lifting capacity, and in the extended position of the counterweight system the machine may have a highest lifting capacity.

During the lift operation, the operator may have to visually determine the position of the counterweight system and estimate an actual and/or maximum lifting capacity of the machine based on operational judgement and skill. In some situations, a possibility of overturning or damaging the machine due to load imbalance, excessive load, incorrect operator judgement, and so on, may be increased. As such, controlling the machine and the lift operation may be a highly operator dependent task, in turn, increasing operator effort, reducing machine performance, and so on. Hence, there is a need for an improved system and method to determine the lifting capacity of such machines.

U.S. Patent Application Number 2016/0169413 describes a pipelayer having an undercarriage, a boom movable relative to the undercarriage in a first lateral direction, and a counterweight movable relative to the undercarriage in a second lateral direction. The second lateral direction is opposite to the first lateral direction and ranges between a deployed position and a retracted position. A counterweight position sensor determines a current position of the counterweight and generates a counterweight position signal. An operator interface operably coupled to the counterweight position sensor displays counterweight position information based on the counterweight position signal.

SUMMARY OF THE DISCLOSURE

In an aspect of the present disclosure, a system for determining a lifting capacity of a pipelayer is provided. The system includes a load sensor disposed in association with a lifting hook of the pipelayer. The load sensor is configured to generate a signal indicative of a load suspended from the lifting hook. The system includes an angle sensor disposed on a chassis of the pipelayer. The angle sensor is configured to generate a signal indicative of an angular position of the chassis relative to ground surface. The system includes a boom position sensor disposed in association with a boom of the pipelayer. The boom position sensor is configured to generate a signal indicative of a position of the boom relative to an undercarriage of the pipelayer. The system also includes a counterweight position sensor disposed in association with a counterweight system of the pipelayer. The counterweight position sensor is configured to generate a signal indicative of a position of a counterweight relative to the undercarriage. The system further includes a controller communicably coupled to each of the load sensor, the angle sensor, the boom position sensor, and the counterweight position sensor. The controller is configured to receive the signal from each of the load sensor, the angle sensor, the boom position sensor, and the counterweight position sensor. The controller is also configured to determine the lifting capacity of the pipelayer based, at least in part, on the signal received from each of the load sensor, the angle sensor, the boom position sensor, and the counterweight position sensor.

In another aspect of the present disclosure, a pipelayer includes a chassis. The pipelayer includes an undercarriage coupled to the chassis. The pipelayer includes a boom movably coupled to the undercarriage. The boom includes a lifting hook suspended therefrom. The pipelayer includes a counterweight system movably coupled to the undercarriage and disposed opposite to the boom. The pipelayer includes a load sensor disposed in association with the lifting hook. The load sensor is configured to generate a signal indicative of a load suspended from the lifting hook. The pipelayer includes an angle sensor disposed on the chassis. The angle sensor is configured to generate a signal indicative of an angular position of the chassis relative to ground surface. The pipelayer includes a boom position sensor disposed in association with the boom. The boom position sensor is configured to generate a signal indicative of a position of the boom relative to the undercarriage. The pipelayer also includes a counterweight position sensor disposed in association with the counterweight system. The counterweight position sensor is configured to generate a signal indicative of a position of a counterweight relative to the undercarriage. The pipelayer further includes a controller communicably coupled to each of the load sensor, the angle sensor, the boom position sensor, and the counterweight position sensor. The controller is configured to receive the signal from each of the load sensor, the angle sensor, the boom position sensor, and the counterweight position sensor. The controller is also configured to determine the lifting capacity of the pipelayer based, at least in part, on the signal received from each of the load sensor, the angle sensor, the boom position sensor, and the counterweight position sensor.

In yet another aspect of the present disclosure, a method for determining a lifting capacity of a pipelayer is provided. The method includes receiving a signal indicative of a load suspended from a lifting hook of the pipelayer. The method includes receiving a signal indicative of an angular position of a chassis of the pipelayer relative to ground surface. The method includes receiving a signal indicative of a position of a boom of the pipelayer relative to an undercarriage of the pipelayer. The method also includes receiving a signal indicative of a position of a counterweight of a counterweight system of the pipelayer relative to the undercarriage. The method further includes determining the lifting capacity of the pipelayer based, at least in part, on the received signals.

Other features and aspects of this disclosure will be apparent from the following description and the accompanying drawings.

DETAILED DESCRIPTION

Figure 1:
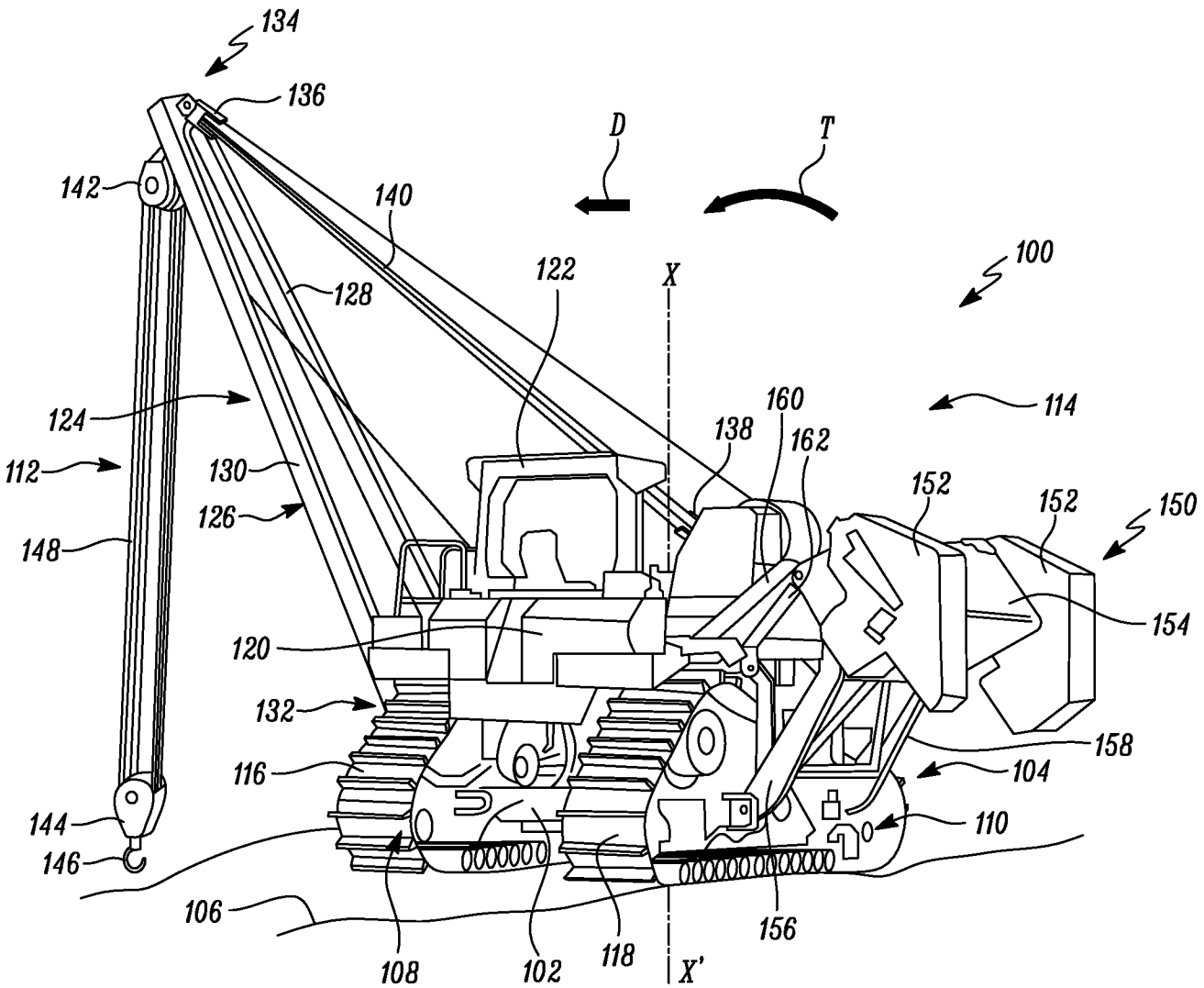
FIG. 1 is a perspective view of an exemplary pipelayer, according to one embodiment of the present disclosure.

Wherever possible, the same reference numbers will be used throughout the drawings to refer to the same or like parts. Referring to FIG. 1, a perspective view of an exemplary pipelayer 100 is illustrated. The pipelayer 100 may be used to lift and/or lower a load, such as a conduit segment, a pipe segment, a culvert segment, a drainage segment, and so on, during a pipelaying operation. The pipelayer 100 includes a chassis 102. The chassis 102 defines a central axis X-X' of the pipelayer 100. The chassis 102 supports one or more components of the pipelayer 100. The pipelayer 100 includes an undercarriage 104 operably coupled to the chassis 102. The undercarriage 104 supports the pipelayer 100 on ground surface 106.

The undercarriage 104 includes a set of track roller frames, such as a first track roller frame 108 and a second track roller frame 110. The first track roller frame 108 is disposed on a first side 112 of the pipelayer 100 relative to the central axis X-X. The second track roller frame 110 is disposed on a second side 114 of the pipelayer 100 relative to the central axis X-X. The first track roller frame 108 includes a first track 116, and the second track roller frame 110 includes a second track 118. Each of the first track 116 and the second track 118 supports and provides mobility to the pipelayer 100 on the ground surface 106. Additionally, each of the first track roller frame 108 and the second track roller frame 110 may include additional components (not shown), such as a drive sprocket, one or more idlers, one or more rollers, and so on, based on application requirements.

The pipelayer 100 includes an enclosure 120 mounted on the chassis 102. The enclosure 120 houses a power source (not shown), such as an engine, batteries, and so on, of the pipelayer 100. The power source provides power to the pipelayer 100 for operational and mobility requirements. The pipelayer 100 also includes an operator cabin 122 mounted on the chassis 102. The operator cabin 122 includes various controls (not shown), such as a steering, a joystick, an operator console, an operator seat, levers, pedals, buttons, switches, knobs, and so on. The controls are adapted to control the pipelayer 100 on the ground surface 106 and during the pipelaying operation. Additionally, the pipelayer 100 may include one or more components and/or systems (not shown), such as a propulsion system, a drivetrain, a hydraulic system, a fuel control system, an engine control system, an air delivery system, a lubrication system, a cooling system, a drive control system, a machine control system, and so on, based on application requirements.

The pipelayer 100 further includes a boom assembly 124. The boom assembly 124 is disposed on the first side 112 of the pipelayer 100. The boom assembly 124 is operably coupled to the undercarriage 104 and the chassis 102. The boom assembly 124 is adapted to lift and lower the load during the pipelaying operation. The boom assembly 124 includes a boom member 126. In the illustrated embodiment, the boom member 126 includes two leg segments, such as a first leg segment 128 and a second leg segment 130. As such, in the illustrated embodiment, the boom member 126 has a substantially elongated and triangular configuration. In other embodiments, the boom member 126 may include single or multiple leg segments, based on application requirements.

The boom member 126 includes a first end 132 and a second end 134. The second end 134 is disposed opposite to the first end 132. The first end 132 is removably and hingedly coupled to the first track roller frame 108 of the pipelayer 100. The boom assembly 124 includes a first boom block 136. The first boom block 136 is removably and hingedly coupled to the second end 134 of the boom member 126. The boom assembly 124 includes a second boom block 138 removably and hingedly coupled to the chassis 102 of the pipelayer 100. The second boom block 138 is operably coupled to the first boom block 136 using at least one first cable 140. The first cable 140 may be further operably coupled to a block winch (not shown) disposed on the chassis 102. Accordingly, based on an operation of the block winch, the first cable 140 may be retracted or extended in order to raise or lower the second end 134 of the boom member 126, respectively, relative to the ground surface 106.

The boom assembly 124 includes a first hook block 142 removably and hingedly coupled to the second end 134 of the boom member 126. The first hook block 142 is disposed opposite to the first boom block 136 on the second end 134 of the boom member 126. The boom assembly 124 includes a second hook block 144 having a lifting hook 146. The second hook block 144 is operably coupled to the first hook block 142 using at least one second cable 148. The second cable 148 may be further operably coupled to a hook winch (not shown) disposed on the chassis 102. Accordingly, based on an operation of the hook winch, the second cable 148 may be retracted or extended in order to raise or lower the second hook block 144 and the lifting hook 146, respectively, relative to the ground surface 106.

Figure 3B:
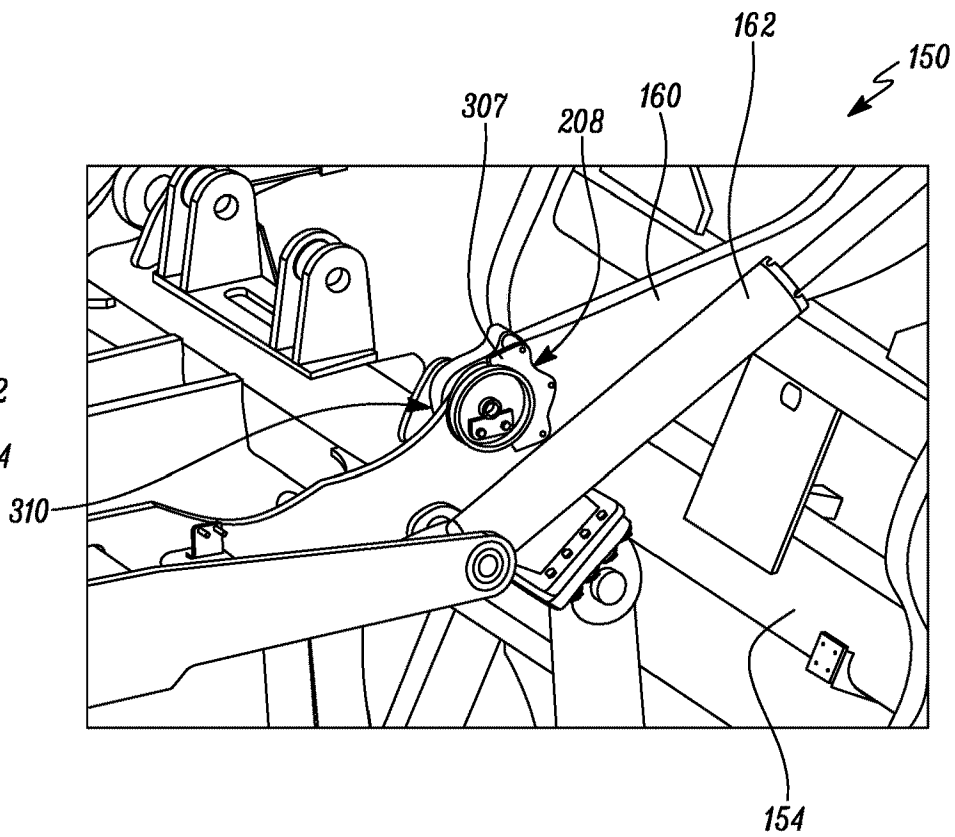
FIGS. 3A and 3B are different perspective views of a counterweight system of the pipelayer, according to one embodiment of the present disclosure.
Figure 3A:
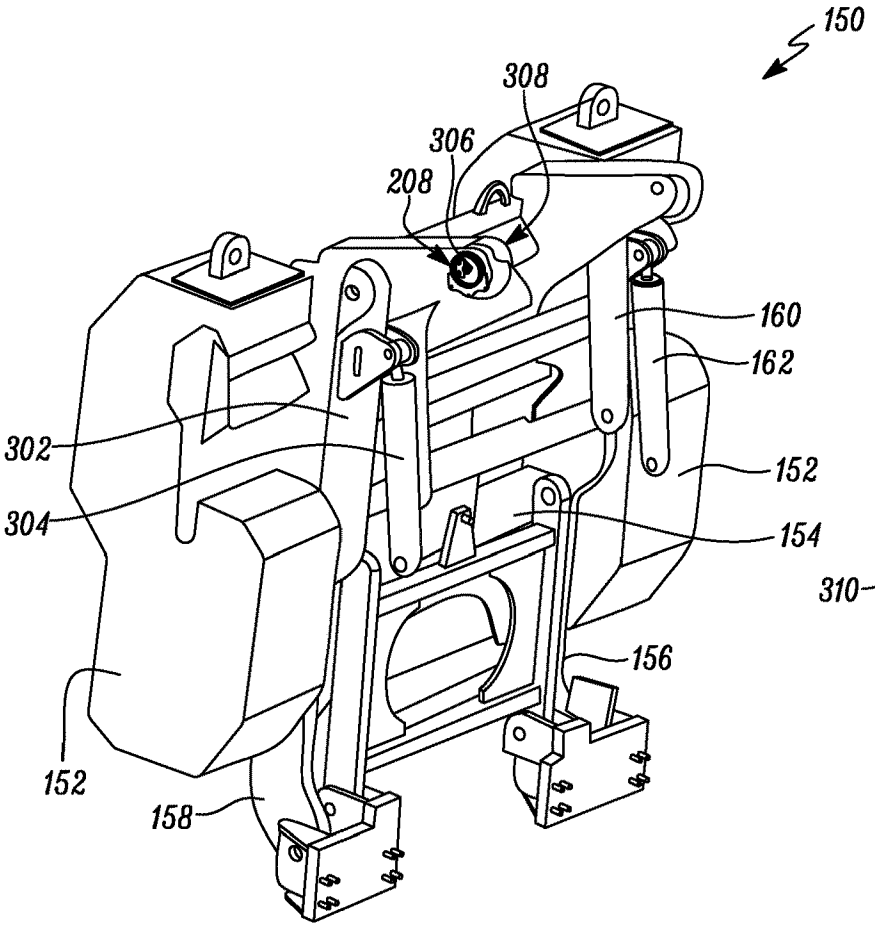

Referring to FIGS. 1, 3A, and 3B, the pipelayer 100 also includes a counterweight system 150. The counterweight system 150 is disposed on the second side 114 of the pipelayer 100. The counterweight system 150 includes one or more counterweights 152 disposed on a counterweight frame 154. The counterweight frame 154 is movably coupled to the pipelayer 100 using a set of arms, such as lower arms 156, 158 and upper arms 160, 302. More specifically, each of the lower arms 156, 158 are movably coupled to each of the second track roller frame 110 and the counterweight frame 154. Also, each of the upper arms 160, 302 are movably coupled to each of the chassis 102 and the counterweight frame 154. Additionally, the counterweight system 150 includes one or more actuators, such as hydraulic cylinders 162, 304, operably coupled between the chassis 102 and the counterweight frame 154. Based on an operation of the hydraulic cylinders 162, 304, the counterweight frame 154 and the counterweights 152 are adapted to move between a retracted position (shown in FIGS. 1 and 3A) and an extended position (shown partially in FIG. 3B) relative to the chassis 102 of the pipelayer 100. As such, based on the position of the counterweights 152, the counterweight system 150 is adapted to provide a variable load lifting capacity of the pipelayer 100.

Figure 2:
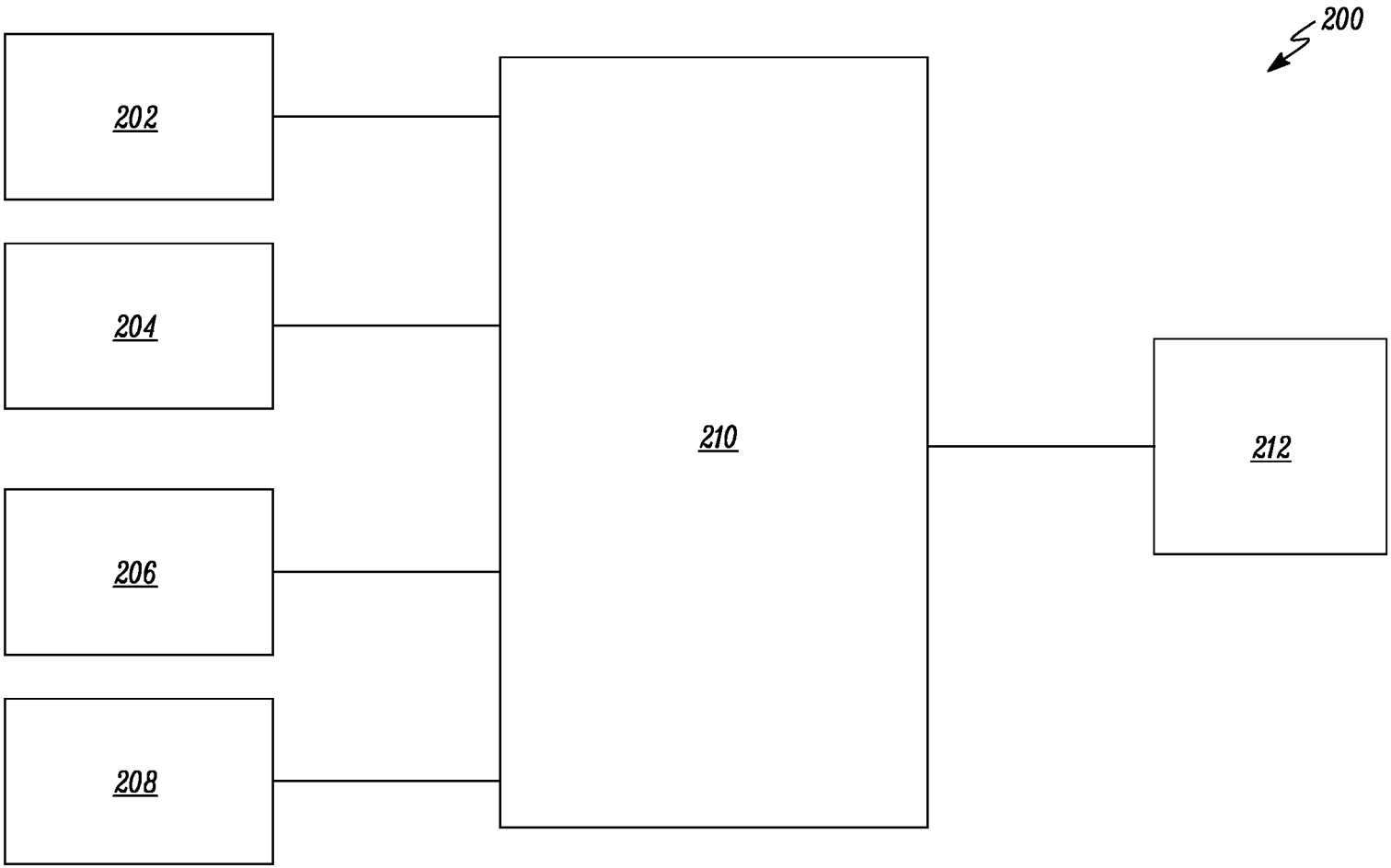
FIG. 2 is a schematic representation of a system for determining a lifting capacity of the pipelayer, according to one embodiment of the present disclosure.

The present disclosure relates to a system 200 for determining a lifting capacity of the pipelayer 100. Referring to FIG. 2, a schematic representation of the system 200 is illustrated. The system 200 includes a load sensor 202. The load sensor 202 is disposed in association with the lifting hook 146 of the pipelayer 100. For example, in one embodiment, the load sensor 202 may be disposed on the lifting hook 146. In another embodiment, the load sensor 202 may be disposed on the second hook block 144. In another embodiment, the load sensor 202 may be disposed on the first hook block 142.

In another embodiment, the load sensor 202 may be disposed on the first boom block 136. In another embodiment, the load sensor 202 may be disposed on the second boom block 138. In yet another embodiment, the load sensor 202 may be disposed on the block winch, and so on. The load sensor 202 may be any load sensor, such as a strain gauge type load sensor, a piezoelectric type load sensor, a pneumatic type load sensor, a hydraulic type load sensor, and so on, based on application requirements. The load sensor 202 is configured to generate a signal indicative of the load suspended from the lifting hook 146.

The system 200 includes an angle sensor 204. The angle sensor 204 is disposed on the chassis 102 of the pipelayer 100. The angle sensor 204 may be any orientation sensor, such as an accelerometer, a gyroscope, a magnetometer, an Inertial Measurement Unit IMU) sensor, and so on, based on application requirements. The angle sensor 204 is configured to generate a signal indicative of an angular position of the chassis 102 relative to the ground surface 106. More specifically, the angle sensor 204 is configured to generate a signal indicative of an orientation of the pipelayer 100 relative to the ground surface 106, such as machine roll, machine pitch, and so on.

The system 200 includes a boom position sensor 206. The boom position sensor 206 is disposed in association with the boom member 126 of the pipelayer 100. In one embodiment, the boom position sensor 206 may be disposed on the boom member 126. In another embodiment, the boom position sensor 206 may be disposed on the chassis 102 and in association with the boom member 126. The boom position sensor 206 may be any linear or angular position sensor, such as a capacitance type position sensor, a resistance type position sensor, an inductive type position sensor, a magnetic type position sensor, an ultrasonic type position sensor, a proximity sensor, an Inertial Measurement Unit IMU) sensor, and so on, based on application requirements. The boom position sensor 206 is configured to generate a signal indicative of a position, such as an angular position, a boom overhang, and so on, of the boom relative to the undercarriage 104 of the pipelayer 100.

The system 200 also includes a counterweight position sensor 208. The counterweight position sensor 208 is disposed in association with the counterweight system 150 of the pipelayer 100. In one embodiment, as shown in FIGS. 3A and 3B, the counterweight position sensor 208 may be a rotary angle sensor 306, 307. In such a situation, the counterweight position sensor 208 may be disposed on a rotating joint associated with one of the lower arm 156, 158 or the upper arm 160, 302 of the counterweight system 150. For example, in one embodiment, referring to FIG. 3A, the rotary angle sensor 306 may be disposed on an upper rotating joint 308 of the counterweight system 150. In another embodiment, referring to FIG. 3B, the rotary angle sensor 307 may be disposed on a lower rotating joint 310 of the counterweight system 150.

In another embodiment, the counterweight position sensor 208 may be a cylinder position sensor (not shown). In such a situation, the counterweight position sensor 208 may be disposed in association with one of more of the hydraulic cylinders 162, 304 associated with the counterweight system 150. As such, the cylinder position sensor may generate a signal indicative of a position of the respective hydraulic cylinder. The position of the respective hydraulic cylinder may be further indicative of a position of the counterweight 152 relative to the undercarriage 104. In another embodiment, the counterweight position sensor 208 may be an Inertial Measurement Unit (IMU) sensor. In such a situation, the counterweight position sensor 208 may be disposed on the counterweight frame 154 of the counterweight system 150. As such, it should be noted that the counterweight position sensor 208 may be any position sensor configured to generate the signal indicative of the position, such as an angular position, a counterweight overhang, and so on, of the counterweight 152 relative to the undercarriage 104.

The system 200 further includes a controller 210. The controller 210 may be any control unit configured to perform various functions of the system 200. In one embodiment, the controller 210 may be a dedicated control unit configured to perform functions related to the system 200. In another embodiment, the controller 210 may be a Machine Control Unit (MCU) associated with the pipelayer 100, an Engine Control Unit (ECU) associated with the engine, and so on configured to perform functions related to the system 200.

The controller 210 is communicably coupled to each of the load sensor 202, the angle sensor 204, the boom position sensor 206, and the counterweight position sensor 208. Accordingly, the controller 210 is configured to receive the signal from each of the load sensor 202, the angle sensor 204, the boom position sensor 206, and the counterweight position sensor 208. More specifically, the controller 210 is configured to receive the signal indicative of the load suspended from the lifting hook 146 from the load sensor 202. The controller 210 is configured to receive the signal indicative of the angular position of the chassis 102 relative to the ground surface 106 from the angle sensor 204. The controller 210 is also configured to receive the signal indicative of the position of the boom member 126 relative to the undercarriage 104 from the boom position sensor 206. The controller 210 is further configured to receive the signal indicative of the position of the counterweight 152 relative to the undercarriage 104 from the counterweight position sensor 208.

Based on the received signals, the controller 210 is further configured to determine the lifting capacity of the pipelayer 100 based, at least in part, on the signal received from each of the load sensor 202, the angle sensor 204, the boom position sensor 206, and the counterweight position sensor 208. In one embodiment, the controller 210 may be configured to determine the lifting capacity of the pipelayer 100 based on a pre-calibrated dataset (not shown). The pre-calibrated dataset may be stored in a database (not shown) communicably coupled to the controller 210 or an internal memory (not shown) of the controller 210.

In one embodiment, the pre-calibrated dataset may include a lookup table. In another embodiment, the pre-calibrated dataset may include a reference map. The lookup table or the reference map may include various values of the lifting capacity corresponding to different values of each of the load suspended from the lifting hook 146, the angular position of the chassis 102, the position of the boom member 126, and the position of the counterweight 152. In such a situation, the controller 210 may look up or refer the value of the lifting capacity based on actual values of each of the load suspended from the lifting hook 146, the angular position of the chassis 102, the position of the boom member 126, and the position of the counterweight 152.

In another embodiment, the controller 210 may be configured to determine the lifting capacity of the pipelayer 100 based on a predefined relationship. The predefined relationship may be stored in the database or the internal memory of the controller 210. The predefined relationship may be a mathematical expression or formula between the lifting capacity and each of the load suspended from the lifting hook 146, the angular position of the chassis 102, the position of the boom member 126, and the position of the counterweight 152. In yet other embodiments, the predetermined relationship may be any other predetermined mathematical equation, relation, model or algorithm for determining the lifting capacity of the pipelayer 100. For example, the predetermined relationship may be a multiple polynomial regression model, a physics-based model, a neural network model, any other model or algorithm, or a combination thereof.

More specifically, the controller 210 is configured to determine the lifting capacity of the pipelayer 100 based on a position of a center of gravity of the pipelayer 100. The position of the center of gravity of the pipelayer 100 is based, at least in part, on the load suspended from the lifting hook 146, the angular position of the chassis 102, the position of the boom member 126, and the position of the counterweight 152. For example, based on each of the load suspended from the lifting hook 146, the angular position of the chassis 102, the position of the boom member 126, and the position of the counterweight 152, the position of the center of gravity of the pipelayer 100 may vary between the first side 112 and the second side 114 of the pipelayer 100 about the central axis X-X.

As such, in a situation when the position of the center of gravity may extend beyond a threshold distance relative to the central axis X-X' of the pipelayer 100, the pipelayer 100 may tip over about a tipping point. For example, when an overall load on the first side 112 may exceed an overall load on the second side 114 of the pipelayer 100, the position of the center of gravity may extend toward the first side 112 of the pipelayer 100 and away from the central axis X-X' in a direction "D". When the position of the center of gravity may extend beyond the threshold distance relative to the central axis X-X' on the first side 112 of the pipelayer 100 in the direction "D", the pipelayer 100 may tip over about the first track 116, as shown by an arrow "T".

Figure 4B:
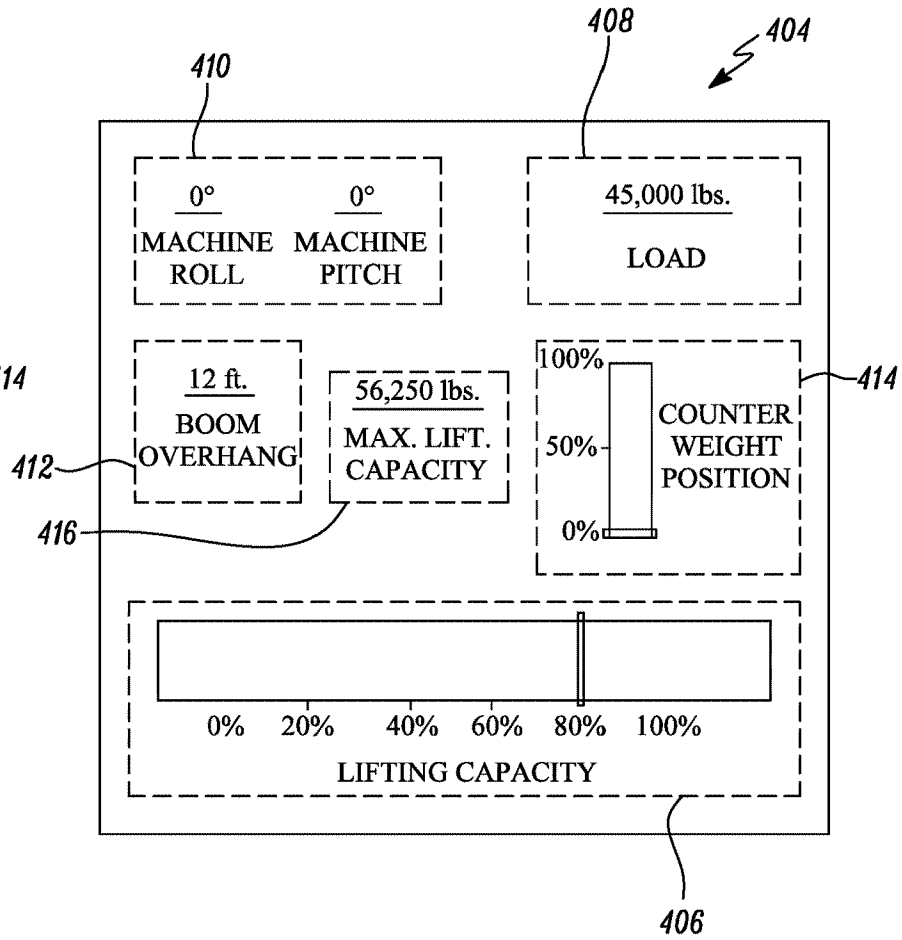
FIGS. 4A and 4B are exemplary displays of the system for determining the lifting capacity of the pipelayer, according to one embodiment of the present disclosure.
Figure 4A:
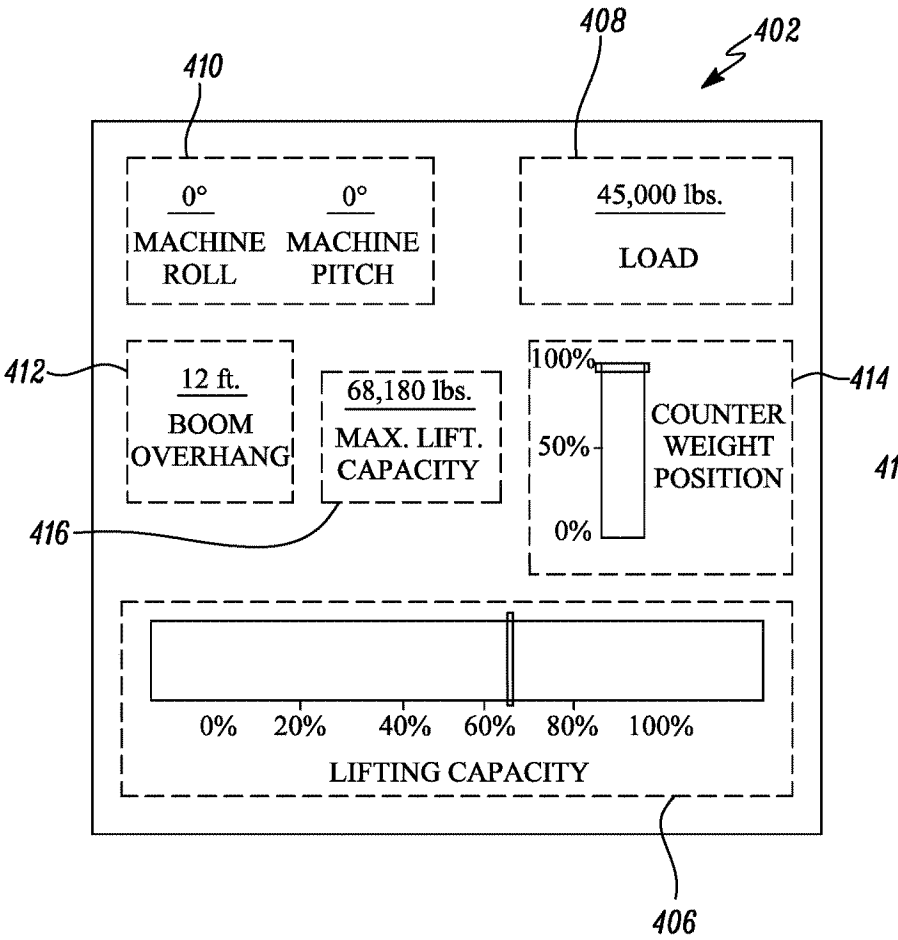

The controller 210 is further configured to provide the determined lifting capacity to an operator (not shown). As such, the controller 210 may be communicably coupled to an operator interface 212 in order to provide the determined lifting capacity to the operator. Referring to FIGS. 4A and 4B, exemplary displays 402, 404 of the operator interface 212 are illustrated. The operator interface 212 may be a display screen, such as a Light Emitting Diode (LED) screen, a Liquid Crystal Display (LCD) screen, a touchscreen, and so on, based on application requirements. In the illustrated embodiment, the controller 210 provides the determined lifting capacity using a visual indication to the operator through the operator interface 212, as shown in block 406. Also, the controller 210 may provide the determined lifting capacity in a percentage value, a graphical representation, and/or a combination thereof to the operator through the operator interface 212.

Additionally, the controller 210 is configured to provide the load suspended from the lifting hook 146 to the operator through the operator interface 212, as shown in block 408. The controller 210 is also configured to provide the angular position of the chassis 102 relative to the ground surface 106 to the operator through the operator interface 212, as shown in block 410. The controller 210 is also configured to provide the position of the boom member 126 relative to the undercarriage 104 to the operator through the operator interface 212, as shown in block 412. The controller 210 is further configured to provide the position of the counterweight 152 relative to the undercarriage 104 to the operator through the operator interface 212, as shown in block 414.

In a situation, as shown in FIG. 4A, when the machine roll may be 0 degrees (°) (as shown in block 410), the machine pitch may be 0° (as shown in block 410), the boom overhang may be 12 feet (ft.), (as shown in block 412), and the load on the lifting hook 146 may be 45,000 pounds (lbs.), (as shown in block 408), and the position of the counterweight 152 may be at full extension or 100% (as shown in block 414), the lifting capacity of the pipelayer 100 may be approximately 66% (as shown in block 406). In such a situation, a maximum lifting capacity of the pipelayer 100 may be approximately 68,180 lbs. and may be indicated to the operator via a block 416.

In another situation, as shown in FIG. 5B, when the machine roll may be 0°, the machine pitch may be 0°, the boom overhang may be 12 ft., and the load on the lifting hook 146 may be 45,000 lbs., and the position of the counterweight 152 may be at full retraction or 0%, the lifting capacity of the pipelayer 100 may be approximately 80%. In such a situation, the maximum lifting capacity of the pipelayer 100 may be approximately 56,250 lbs. Accordingly, based on the position of the counterweight 152 varying between 100% and 0%, the lifting capacity of the pipelayer 100 may vary between approximately 66% and 80%, respectively. As such, when the lifting capacity of the pipelayer 100 may reach 100%, the pipelayer 100 may tip over about the first track 116.

In the accompanying drawings, each of the machine roll, the machine pitch, the boom overhang, the load on the lifting hook 146, and the maximum lifting capacity of the pipelayer 100 is indicated in numerical values. Also, each of the position of the counterweight 152 and the lifting capacity of the pipelayer 100 is indicated in percentage values and graphical indications. In other embodiments, each of the machine roll, the machine pitch, the boom overhang, the load on the lifting hook 146, the maximum lifting capacity of the pipelayer 100, the position of the counterweight 152, and the lifting capacity of the pipelayer 100 may be indicated in one or more of the numerical values, percentage values, and graphical indications, based on application requirements.

In another embodiment, the controller 210 may be configured to indicate the lifting capacity of the pipelayer 100 to the operator using an audible indication. In such a situation, the controller 210 may be communicably coupled to an audio device, such as a speaker, in order to provide the audible indication. In one embodiment, the audible indication may be a recorded voice. In such a situation, the lifting capacity of the pipelayer 100 may be called out in numerical values or percentage values via the audio device. In another situation, the audible indication may be a horn or a beeping sound. In such a situation, the lifting capacity of the pipelayer 100 may be indicated using various beeping patterns, such intermediate beeps, short beeps, long beeps, continuous beep, and so on, via the audio device. In some embodiments, the controller 210 may be configured to indicate the lifting capacity of the pipelayer 100 to the operator using a combination of the visual indication and the audible indication, based on application requirements.

It should be noted that values of each of the machine roll, the machine pitch, the boom overhang, the load on the lifting hook 146, the maximum lifting capacity of the pipelayer 100, the position of the counterweight 152, and the lifting capacity of the pipelayer 100 described herein are merely exemplary and may vary based on application requirements. It should also be noted that position, orientation, and layout of data displayed on the operator interface 212 is merely exemplary and may vary based on application requirements. It should further be noted that although the boom assembly 124 and the system 200 are described herein with reference to the pipelayer 100, in other embodiments, the boom assembly 124 and the system 200 may be employed on any other lifting machine, such as a crane.

Industrial Applicability

Figure 5:
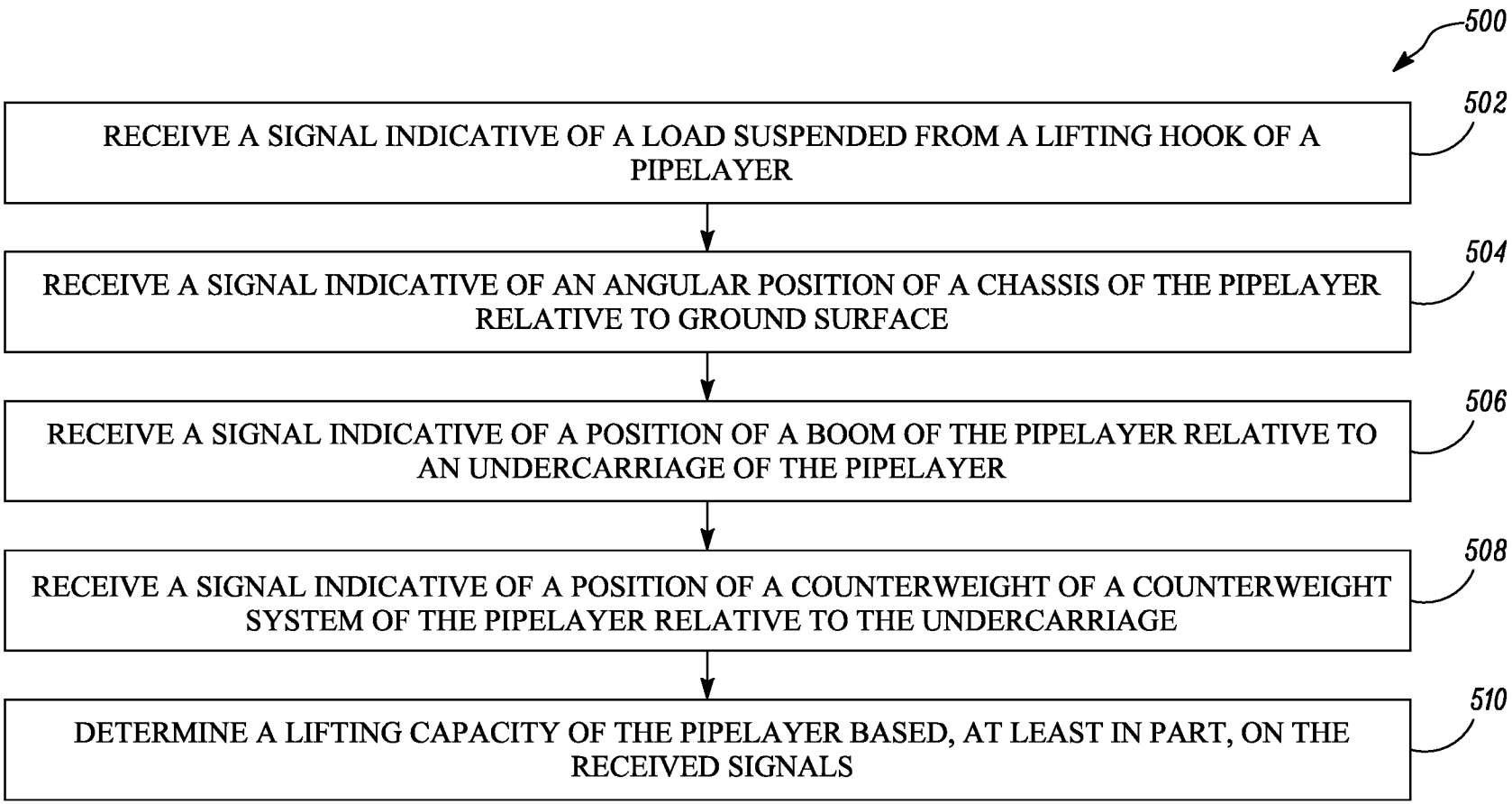
FIG. 5 is a flowchart illustrating a method for determining the lifting capacity of the pipelayer, according to one embodiment of the present disclosure.

The present disclosure relates to a method 500 for determining the lifting capacity of the pipelayer 100. Referring to FIG. 5, a flowchart of the method 500 is illustrated. At step 502, the controller 210 receives the signal indicative of the load suspended from the lifting hook 146 of the pipelayer 100 from the load sensor 202. At step 504, the controller 210 receives the signal indicative of the angular position of the chassis 102 of the pipelayer 100 relative to the ground surface 106 from the angle sensor 204. At step 506, the controller 210 receives the signal indicative of the position of the boom member 126 of the pipelayer 100 relative to the undercarriage 104 of the pipelayer 100 from the boom position sensor 206.

At step 508, the controller 210 receives the signal indicative of the position of the counterweight 152 of the counterweight system 150 of the pipelayer 100 relative to the undercarriage 104 from the counterweight position sensor 208. In one embodiment, the counterweight position sensor 208 may be the rotary angle sensor 306, 307. The rotary angle sensor 306, 307 may be disposed on the upper rotating joint 308 or the lower rotating joint 310 of the counterweight system 150, respectively, as described with reference to FIGS. 3A and 3B. In another embodiment, the counterweight position sensor 208 may be the cylinder position sensor and may be disposed in association with the hydraulic cylinders 162, 304 of the counterweight system 150. In yet another embodiment, the counterweight position sensor 208 may be the IMU sensor and may be disposed on the counterweight frame 154 of the counterweight system 150.

At step 510, the controller 210 determines the lifting capacity of the pipelayer 100 based, at least in part, on the received signals. In one embodiment, the controller 210 may determine the lifting capacity of the pipelayer 100 based on the pre-calibrated dataset, such as the lookup table or the reference map. In another embodiment, the controller 210 may determine the lifting capacity of the pipelayer 100 based on the predefined relationship, such as the mathematical expression or formula, the multiple polynomial regression model, the physics-based model, the neural network model, any other model or algorithm, or a combination thereof. More specifically, the controller 210 determines the lifting capacity of the pipelayer 100 based on the position of the center of gravity of the pipelayer 100 based, at least in part, on the load suspended from the lifting hook 146, the angular position of the chassis 102, the position of the boom member 126, and the position of the counterweight 152.

In one embodiment, the controller 210 may provide the determined lifting capacity in one or more of the numerical value, the percentage value, and the graphical representation to the operator through the operator interface 212 as described with reference to FIGS. 4A and 4B. In another embodiment, the controller 210 may provide the determined lifting capacity using audible indication to the operator through the audio device. The controller 210 may also provide the load suspended from the lifting hook 146, the angular position of the chassis 102, the position of the boom member 126, and the position of the counterweight 152 to the operator through the operator interface 212 as described with reference to FIGS. 4A and 4B.

Additionally, in some embodiments, the system 200 may provide an audible warning and/or a visible warning to the operator and/or other personnel working around the pipelayer 100 when the pipelayer 100 may approach a 100% lifting capacity. The audible warning may be a horn or a beeping sound with intermittent or continuous pattern, a recorded message, and so on. The visible warning may be flashing of lights in the operator cabin 122, flashing of lamps or symbols on the operator interface 212, and so on. In some embodiments, the system 200 may provide the audible warning and/or the visible warning to the operator and/or the personnel working around the pipelayer 100 when one or more parameters of the pipelayer 100 may change without an operator command.

For example, in a situation when the ground surface 106 may give way under the pipelayer 100, the orientation of the pipelayer 100 may change. Such a change in the orientation of the pipelayer 100 without the operator command may be indicated to the operator and/or the personnel working around the pipelayer 100 via the audible warning and/or the visible warning. In such a situation, the system 200 may analyze inputs from the angle sensor 204 in order to determine undesired change in the orientation of the pipelayer 100 and, accordingly, provide the audible warning and/or the visible warning to the operator and/or the personnel working around the pipelayer 100.

In another situation when the load on the lifting hook 146 may change suddenly or may exceed a threshold, one or more parameters of the pipelayer 100, the boom assembly 124, and/or the counterweight system 150 may change without the operator command. For example, in some situations, the orientation of the pipelayer 100 or the position of the boom member 126 may change without the operator command. In another situation, the first cable 140 and/or the second cable 148 may stretch beyond a threshold. In yet another situation, the position of the counterweights 152 may change without the operator command.

Such a change in the parameters of the pipelayer 100, the boom assembly 124, and/or the counterweight system 150 without the operator command may be indicated to the operator and/or the personnel working around the pipelayer 100 via the audible warning and/or the visible warning. In such a situation, the system 200 may analyze inputs from the load sensor 202, the angle sensor 204, the boom position sensor 206, the counterweight position sensor 208, and so on in order to determine undesired change in the parameters of the pipelayer 100, the boom assembly 124, and/or the counterweight system 150 and, accordingly, provide the audible warning and/or the visible warning to the operator and/or the personnel working around the pipelayer 100.

In some embodiments, data generated by the system 200 including, but not limited to, the lifting capacity of the pipelayer 100, the load suspended from the lifting hook 146, the angular position of the chassis 102, the position of the boom member 126, the position of the counterweight 152, undesired changes in one or more other parameters of the pipelayer 100, and so on, may be communicated to other machines working on a worksite. For example, the data generated by the system 200 may be communicated to adjacent machines working on a same pipelaying operation and/or the worksite as that of the pipelayer 100 in order to efficiently manage a load chain relative to each of the machines and the pipelaying operation.

In some embodiments, the data generated by the system 200 may be communicated to a worksite management system associated with the worksite. The worksite management system may be located on the worksite or remotely from the worksite. In such a situation, the data generated by the system 200 may be processed by the worksite management system in order to efficiently manage a number of pipelayers working on the pipelaying operation. As such, the data may be used in order to efficiently manage the load chain relative to each of the pipelayers and the pipelaying operation.

The system 200 provides a simple, effective, and cost-efficient method of providing the lifting capacity of the pipelayer 100 to the operator. As such, the system 200 provides real time lifting capacity of the pipelayer 100 in order to allow the operator to control the pipelayer 100 appropriately, thus, reducing dependence on operator judgement. The counterweight position sensor 208 in combination with the load sensor 202, the angle sensor 204, and the boom position sensor 206 provides improved accuracy in order to determine the lifting capacity of the pipelayer 100, in turn, improving performance.

Additionally, the audible warning and/or the visible warning provided by the system 200 may alert the operator and/or the personnel working around the pipelayer 100 in order to perform corrective/appropriate actions based on movement of the ground surface 106, tip over of the pipelayer 100, load shift, and so on, in turn, improving performance. Also, the system 200 employs already available components on the pipelayer 100 or readily available off-the-shelf components, such as the load sensor 202, the angle sensor 204, the boom position sensor 206, the counterweight position sensor 208, the controller 210, and so on, in turn, reducing complexity and costs. The system 200 may be retrofitted on any lifting machine, such as the crane, other pipelayers, and so on, with little or no modification to existing system, in turn, improving flexibility and compatibility.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of the disclosure. Such embodiments should be understood to fall within the scope of the present disclosure as determined based upon the claims and any equivalents thereof.

What is claimed is:

1. A system for determining a lifting capacity of a pipelayer, the system comprising:

a load sensor disposed in association with a lifting hook of the pipelayer, the load sensor configured to generate a signal indicative of a load suspended from the lifting hook;

an angle sensor disposed on a chassis of the pipelayer, the angle sensor configured to generate a signal indicative of an angular position of the chassis relative to ground surface;

a boom position sensor disposed in association with a boom of the pipelayer, the boom position sensor configured to generate a signal indicative of a position of the boom relative to an undercarriage of the pipelayer;

a counterweight position sensor disposed in association with a counterweight system of the pipelayer, the counterweight position sensor configured to generate a signal indicative of a position of a counterweight relative to the undercarriage; and a controller communicably coupled to each of the load sensor, the angle sensor, the boom position sensor, and the counterweight position sensor, the controller configured to:

receive the signal from each of the load sensor, the angle sensor, the boom position sensor, and the counterweight position sensor; and determine the lifting capacity of the pipelayer based, at least in part, on the signal received from each of the load sensor, the angle sensor, the boom position sensor, and the counterweight position sensor.

2. The system of claim 1, wherein the counterweight position sensor is one of a rotary angle sensor, a cylinder position sensor, and an Inertial Measurement Unit (IMU) sensor.

3. The system of claim 2, wherein:

the rotary angle sensor is disposed on a rotating joint associated with an arm of the counterweight system, the cylinder position sensor is disposed in association with at least one hydraulic cylinder associated with the counterweight system, and the Inertial Measurement Unit (IMU) sensor is disposed on a frame of the counterweight system.

4. The system of claim 1, wherein the controller is configured to determine the lifting capacity of the pipelayer based on a position of a center of gravity of the pipelayer based, at least in part, on the load suspended from the lifting hook, the angular position of the chassis, the position of the boom, and the position of the counterweight.

5. The system of claim 1, wherein the controller is further configured to provide the determined lifting capacity to an operator through an operator interface.

6. The system of claim 5, wherein the controller is further configured to provide the determined lifting capacity in at least one of a percentage value and a graphical representation to the operator through the operator interface.

7. The system of claim 5, wherein the controller is further configured to provide the determined lifting capacity using at least one of an audible indication and a visual indication to the operator through the operator interface.

8. The system of claim 1, wherein the controller is further configured to provide at least one of:

the load suspended from the lifting hook to an operator through an operator interface, the angular position of the chassis relative to the ground surface to the operator through the operator interface, the position of the boom relative to the undercarriage to the operator through the operator interface, and the position of the counterweight relative to the undercarriage to the operator through the operator interface.

9. A pipelayer comprising:

a chassis;

an undercarriage coupled to the chassis;

a boom movably coupled to the undercarriage, the boom including a lifting hook suspended therefrom;

a counterweight system movably coupled to the undercarriage and disposed opposite to the boom;

a load sensor disposed in association with the lifting hook, the load sensor configured to generate a signal indicative of a load suspended from the lifting hook;

an angle sensor disposed on the chassis, the angle sensor configured to generate a signal indicative of an angular position of the chassis relative to ground surface;

a boom position sensor disposed in association with the boom, the boom position sensor configured to generate a signal indicative of a position of the boom relative to the undercarriage;

a counterweight position sensor disposed in association with the counterweight system, the counterweight position sensor configured to generate a signal indicative of a position of a counterweight relative to the undercarriage; and a controller communicably coupled to each of the load sensor, the angle sensor, the boom position sensor, and the counterweight position sensor, the controller configured to:

receive the signal from each of the load sensor, the angle sensor, the boom position sensor, and the counterweight position sensor; and determine the lifting capacity of the pipelayer based, at least in part, on the signal received from each of the load sensor, the angle sensor, the boom position sensor, and the counterweight position sensor.

10. The pipelayer of claim 9, wherein the counterweight position sensor is one of a rotary angle sensor, a cylinder position sensor, and an Inertial Measurement Unit (IMU) sensor.

11. The pipelayer of claim 10, wherein:

the rotary angle sensor is disposed on a rotating joint associated with an arm of the counterweight system, the cylinder position sensor is disposed in association with at least one hydraulic cylinder associated with the counterweight system, and the Inertial Measurement Unit (IMU) sensor is disposed on a frame of the counterweight system.

12. The pipelayer of claim 9, wherein the controller is configured to determine the lifting capacity of the pipelayer based on a position of a center of gravity of the pipelayer based, at least in part, on the load suspended from the lifting hook, the angular position of the chassis, the position of the boom, and the position of the counterweight.

13. The pipelayer of claim 9, wherein the controller is further configured to provide the determined lifting capacity to an operator through an operator interface.

14. The pipelayer of claim 13, wherein the controller is further configured to provide the determined lifting capacity in at least one of a percentage value and a graphical representation to the operator through the operator interface.

15. The pipelayer of claim 13, wherein the controller is further configured to provide the determined lifting capacity using at least one of an audible indication and a visual indication to the operator through the operator interface.

16. The pipelayer of claim 9, wherein the controller is further configured to provide at least one of:

the load suspended from the lifting hook to an operator through an operator interface, the angular position of the chassis relative to the ground surface to the operator through the operator interface, the position of the boom relative to the undercarriage to the operator through the operator interface, and the position of the counterweight relative to the undercarriage to the operator through the operator interface.

17. A method for determining a lifting capacity of a pipelayer, the method comprising:

receiving a signal indicative of a load suspended from a lifting hook of the pipelayer;

receiving a signal indicative of an angular position of a chassis of the pipelayer relative to ground surface;

receiving a signal indicative of a position of a boom of the pipelayer relative to an undercarriage of the pipelayer;

receiving a signal indicative of a position of a counterweight of a counterweight system of the pipelayer relative to the undercarriage; and determining the lifting capacity of the pipelayer based, at least in part, on the received signals.

18. The method of claim 17, wherein the signal indicative of the position of the counterweight is received from a rotary angle sensor, and wherein the rotary angle sensor is disposed on a rotating joint associated with an arm of the counterweight system.

19. The method of claim 17 further includes providing the determined lifting capacity in at least one of a percentage value and a graphical representation to an operator.

20. The method of claim 17 further includes providing at least one of:

the load suspended from the lifting hook to an operator, the angular position of the chassis relative to the ground surface to the operator, the position of the boom relative to the undercarriage to the operator, and the position of the counterweight relative to the undercarriage to the operator.

* * * * *